US005557945A

United States Patent [19]

Mangyo et al.

[11] Patent Number: 5,557,945

[45] Date of Patent: Sep. 24, 1996

[54] REFRIGERANT COMPRESSOR AND REFRIGERATION SYSTEM INCORPORATING SAME

[75] Inventors: Masao Mangyo, Fujisawa; Sinya Ito, Yokohama; Seishi Nakaoka, Chigasaki, all of Japan

[73] Assignee: Matsushita Refrigeration Company, Osaka, Japan

[21] Appl. No.: 320,717

[22] Filed: Oct. 11, 1994

[30] Foreign Application Priority Data

Oct. 12, 1993 [JP] Japan ..... 5-254191

[51] Int. Cl.[6] ..... F25B 43/00

[52] U.S. Cl. ..... 62/474; 210/DIG. 6

[58] Field of Search ..... 62/85, 474; 210/DIG. 6

[56] References Cited

U.S. PATENT DOCUMENTS

| | | | |
|---|---|---|---|
| 2,323,160 | 6/1943 | Stecher et al. | 62/474 X |
| 3,841,490 | 10/1974 | Hoffman et al. | 210/DIG. 6 |
| 4,364,756 | 12/1982 | Clarke et al. | 62/85 X |
| 4,637,881 | 1/1987 | Sciuto | 62/474 X |
| 4,811,571 | 3/1989 | Mayer | 62/474 |
| 4,908,132 | 3/1990 | Koval et al. | 62/474 X |
| 5,289,697 | 3/1994 | Hutchison | 62/474 |

FOREIGN PATENT DOCUMENTS

| | | |
|---|---|---|
| 3-128992 | 5/1991 | Japan . |
| 3-128991 | 5/1991 | Japan . |
| 4-183788 | 6/1992 | Japan . |

*Primary Examiner*—William E. Tapolcai

*Attorney, Agent, or Firm*—Lowe, Price, Leblanc & Becker

[57] ABSTRACT

A filter formed of a filter material, such as, fluororesin, cellulose ester, polycarbonate or silica fiber is provided in a refrigerant flow passage of a refrigeration system. In the refrigerant flow passage, the filter is sandwiched by porous members, or the filter is attached to a porous member by means of, such as, heat sealing. The filter may be provided in a drier provided in the refrigerant flow passage. Alternatively, the filter may be provided in the refrigerant flow passage within a sealed casing of a refrigerant compressor which is incorporated in the refrigeration system.

18 Claims, 8 Drawing Sheets

REFRIGERANT COMPRESSOR AND REFRIGERATION SYSTEM INCORPORATING SAME

BACKGROUND OF THE INVENTION

1. Field of the Invention

The present invention relates to a refrigerant compressor and a refrigeration system incorporating same, for use in, such as, an electric refrigerator and an air conditioner.

2. Description of the Prior Art

Recently, in consideration of the environmental pollution and, particularly, the ozone destruction and the global warming, the use of the chlorine-contained freon (chlorofluorocarbons abbreviated as CFC) has been decided to be regulated worldwidely. In response to this, researches have been actively performed by the associated makers, such as, the refrigerant makers, the refrigeration system makers and the oil makers. As a result of the researches, a refrigerant containing, as a main component, chlorine-free carbon fluoride, particularly, known as HFC-134*a* (hereinafter referred to as "HFC-134*a* refrigerant"), has been widely admitted as an alternative refrigerant for a CFC refrigerant containing chlorine-contained carbon fluoride, particularly, CFC-12 which has been widely used. Further, in view of required solubility with the HFC-134*a* refrigerant, a lubricating oil containing an ester oil as a main component (hereinafter referred to as "ester lubricating oil") has been developed as disclosed in Japanese First (unexamined) Patent Publications Nos. 3-128991 and 3-128992.

FIG. 14 is a diagram schematically showing a typical conventional refrigeration system 15 as disclosed in Japanese First (unexamined) Patent Publication No. 4-183788. In FIG. 14, the refrigeration system 15 includes a refrigerant compressor 10, a condenser 11, a drier 14, an expansion mechanism 12 in the form of a capillary tube and an evaporator 13, which are hermetically connected by piping as shown. Further, in the refrigeration system 15, the foregoing HFC-134*a* refrigerant and the foregoing ester lubricating oil are hermetically enclosed for circulation in a direction of an arrow as indicated in FIG. 14.

However, in the foregoing conventional refrigeration system, there has been raised a serious problem that the cooling power of the refrigeration system was decreased while operated for a long time. The reason for this was found as follows:

During production processes of the refrigerant compressor and the evaporator, a solvent is used for washing and a mineral oil is used for assembling so that these organic substances remain inside the refrigeration system even in a small amount. The ester lubricating oil dissolves these organic substances to produce contaminants. These contaminants block or deteriorate the flow of the refrigerant in the capillary tube so as to lower the cooling power of the refrigeration system.

In the circumstances, component parts of the refrigeration system were fully washed using a solvent or a surface active agent, and then the ester lubricating oil was filled in. As a result, an amount of the generated contaminants was reduced. However, the generation of the contaminants in the refrigeration system could not be prevented completely however carefully the component parts of the refrigeration system were washed. Although only a slight amount of the contaminants was generated after the washing, the generated contaminants choked or plugged the capillary tube to increase a flow resistance of the capillary tube so that the cooling power of the refrigeration system is adversely affected. As a result, the lowering of the cooling power could not be avoided in the conventional refrigeration system using the ester lubricating oil.

This means that the conventional refrigeration system can not effectively capture the contaminants generated due to dissolution of the organic substances by the ester lubricating oil.

SUMMARY OF THE INVENTION

Therefore, it is an object of the present invention to provide an improved refrigerant compressor.

It is another object of the present invention to provide an improved refrigeration system.

According to one aspect of the present invention, a refrigeration system comprises a series of a refrigerant flow passage including therein a refrigerant compressor, a condenser, a drier, an expansion mechanism and an evaporator; a refrigerant containing, as a main component, a chlorine-free carbon fluoride compound; a lubricating oil containing ester as a main component, the lubricating oil having solubility with the refrigerant; and a filter provided in the refrigerant flow passage, the filter formed of a film material being one of fluororesin, cellulose ester, polycarbonate and silica fiber.

According to another aspect of the present invention, a refrigeration system comprises a series of a refrigerant flow passage including therein a refrigerant compressor, a condenser, a drier, an expansion mechanism and an evaporator; a refrigerant containing, as a main component, a chlorine-free carbon fluoride compound; a lubricating oil containing ester as a main component, the lubricating oil having solubility with the refrigerant; a filter of a cylindrical shape provided in the refrigerant flow passage, the filter formed of a film material being one of fluororesin, cellulose ester, polycarbonate and silica fiber; and a cylindrical member received in the cylindrical filter, the cylindrical member formed of synthetic resin and fixed to the cylindrical filter by means of heat sealing.

According to another aspect of the present invention, a refrigeration system comprises a series of a refrigerant flow passage including therein a refrigerant compressor, a condenser, a drier, an expansion mechanism and an evaporator; a refrigerant containing, as a main component, a chlorine-free carbon fluoride compound; a lubricating oil containing ester as a main component, the lubricating oil having solubility with the refrigerant; a tube provided in the drier, the tube formed of elastomer which is non-polar to the refrigerant and the lubricating oil, the tube extending along an inner wall of the drier; and a filter provided in the tube, the filter formed of a film material being one of fluororesin, cellulose ester, polycarbonate and silica fiber.

According to another aspect of the present invention, in a refrigeration system having a series of a refrigerant flow passage including therein a refrigerant compressor, a condenser, a drier, an expansion mechanism and an evaporator; a refrigerant containing, as a main component, a chlorine-free carbon fluoride compound; and a lubricating oil containing ester as a main component, the lubricating oil having solubility with the refrigerant, the refrigerant compressor comprises a sealed casing; a tube provided in the refrigerant flow passage within the sealed casing, the tube formed of elastomer which is non-polar to the refrigerant and the lubricating oil; and a filter provided in the tube, the filter formed of a film material being one of fluororesin, cellulose ester, polycarbonate and silica fiber.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Now, preferred embodiments of the present invention will be described hereinbelow with reference to the accompanying drawings.

Figure 1:
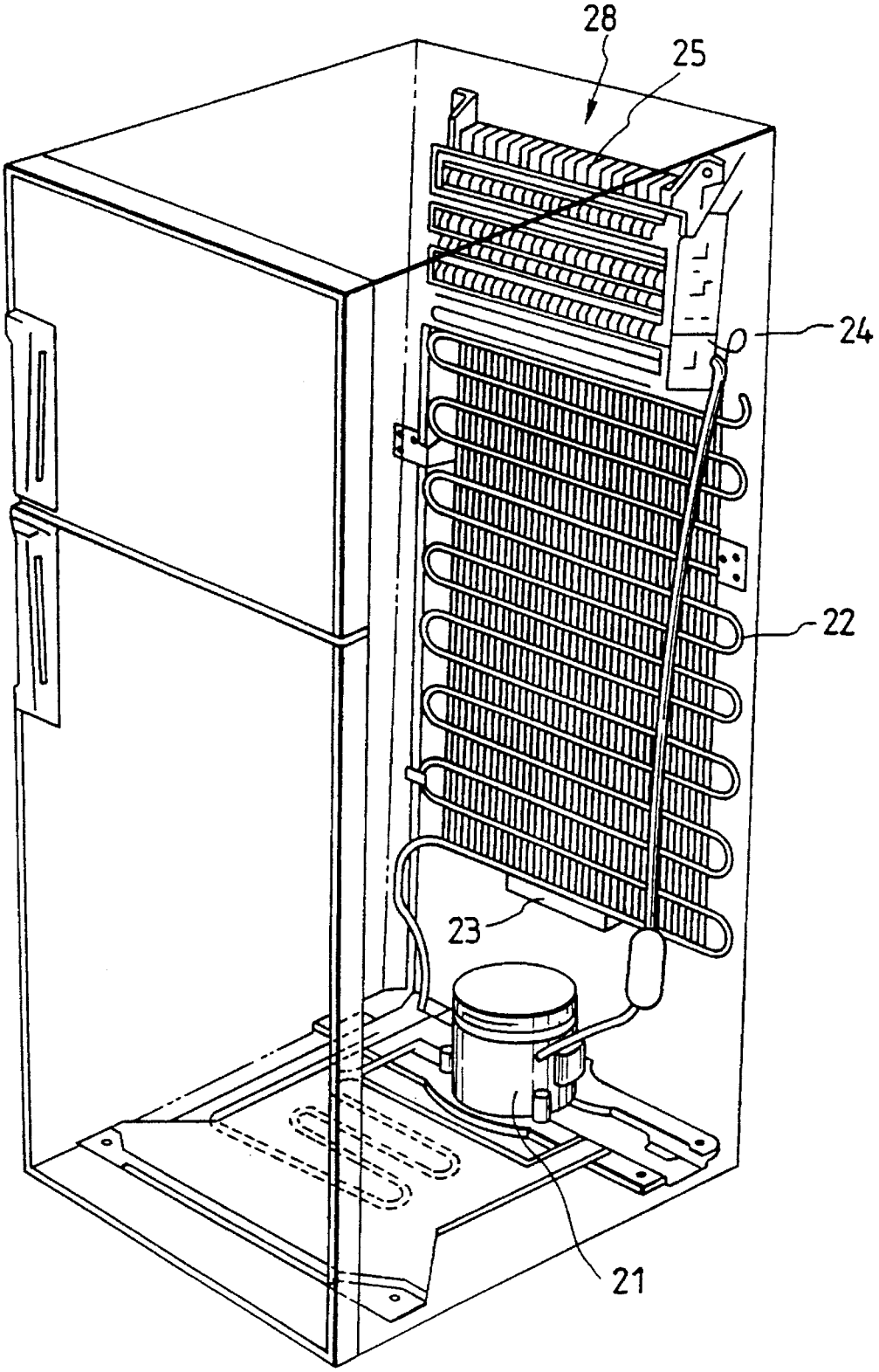
FIG. 1 is a perspective view showing a refrigeration system of an electric refrigerator according to a first preferred embodiment of the present invention.

FIG. 1 shows a refrigeration system 28 of an electric refrigerator according to a first preferred embodiment of the present invention. The refrigeration system 28 includes a compressor 21, a condenser 22, a drier 23, an expansion mechanism 24 and an evaporator 25, which are hermetically connected by piping so as to form a series of a refrigerant flow passage. This refrigerant flow passage hermetically encloses therein the HFC-134*a* refrigerant containing a chlorine-free carbon fluoride compound as a main component and the ester lubricating oil containing ester as a main component and having solubility with the HFC-134*a* refrigerant.

Although this embodiment relates to the refrigeration system of the electric refrigerator, the present invention is not limited thereto and may apply to, such as, a refrigeration system of an air conditioner.

Figure 2:
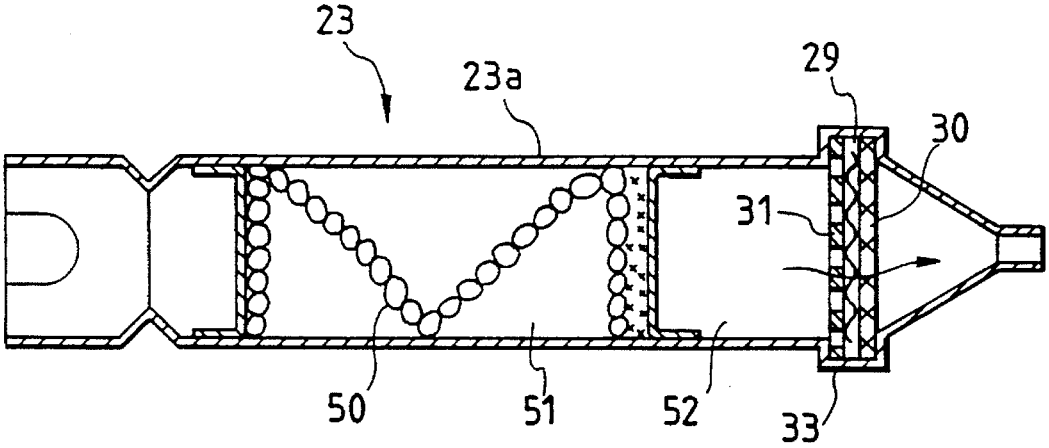
FIG. 2 is a sectional view showing a structure of a drier according to the first preferred embodiment.

FIG. 2 is a sectional view of the drier 23 incorporated in the refrigeration system 28 shown in FIG. 1. The drier 23 has a drier case **23*a* in which a molecular sieve chamber 51 and a filter chamber 52 are defined adjacent to each other. The drier case 23*a* is formed with a flanged portion 33 at the filter chamber 52 so that a diameter of the drier case 23*a* and thus that of the filter chamber 52 are increased at that flanged portion 33. In the molecular sieve chamber 51, a molecular sieve 50** is arranged in the known manner for working as desiccant.

On the other hand, in the filter chamber 52, a filter 29 formed of a very fine filtering film, such as, a single- or double-layer film of polytetrafluoroethylene is provided in the flanged portion 33. Specifically, the filter 29 is sandwiched between a metal screen 30 and a punching metal plate 31, and this three-component composite is tightly mounted in the flanged portion 33 to ensure that the HFC-134*a* refrigerant flowing in the drier 23 passes through the filter 29 as much as possible. As appreciated, the tight arrangement of the forgoing three-component composite in the flanged portion 33 effectively prevents the HFC-134*a* refrigerant from bypassing the filter 29, that is, from passing through between an inner wall surface of the flanged portion 33 and a radially outer circumference of the three-component composite.

It is to be noted that the filter 29 may be formed of such a film material as fluororesin, cellulose ester, polycarbonate or silica fiber.

According to the foregoing first preferred embodiment, since the filter 29 may have a very small pore size which will be described later, the contaminants generated due to dissolution of the organic substances by the ester lubricating oil can be effectively captured by the filter 29 provided in the flanged portion 33 of the drier 23. Accordingly, the lowering of the cooling power can be effectively avoided, which is otherwise caused due to the choking of the capillary tube caused by the generated contaminants.

As appreciated, since the metal screen 30 and the punching metal plate 31 are both porous members, that is, having a number of small openings therein, the filtering operation of the filter 29 is not deteriorated.

Now, a second preferred embodiment of the present invention will be described with reference to FIG. 3. The second preferred embodiment differs from the first preferred embodiment only in structure of the drier 23.

Figure 3:
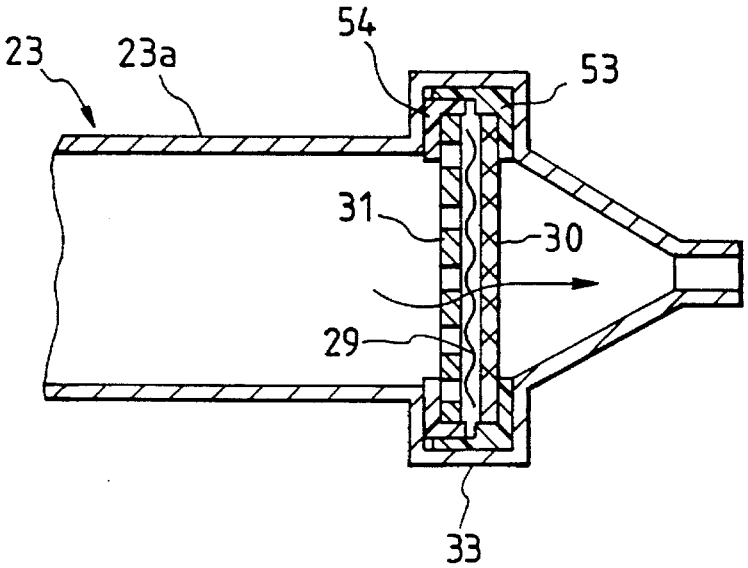
FIG. 3 is a sectional view showing a main portion of a drier according to a second preferred embodiment of the present invention.

As shown in FIG. 3, in the second preferred embodiment, the filter 29 is sandwiched between the metal screen 30 and the punching metal plate 31 as in the first preferred embodiment. The three-component composite of the filter 29, the metal screen 30 and the punching metal plate 31 is firmly mounted in the flanged portion 33 by means of a pair of seal collars 53 and 54. Specifically, the three-component composite is sandwiched between the seal collars 53 and 54 which cover the three-component composite from opposite sides thereof and along its circumference. With this arrangement, the three-component composite along with the seal collars 53 and 54 is tightly mounted in the flanged portion 33.

Each of the seal collars 53 and 54 may be formed of synthetic resin, such as, polytetrafluoroethylene.

According to the second preferred embodiment, the tight arrangement, in the flanged portion 33, of the forgoing three-component composite and the seal collars 53 and 54 can prevent the HFC-134*a* refrigerant from bypassing the filter 29 further reliably as compared with the foregoing first preferred embodiment. As a result, substantially all the HFC-134*a* refrigerant flowing in the drier 23 may pass through the filter 29 so as to further improve the capturing of the generated contaminants.

Now, a third preferred embodiment of the present invention will be described with reference to FIG. 4. The third preferred embodiment differs from the first preferred embodiment only in structure of the drier 23.

Figure 4:
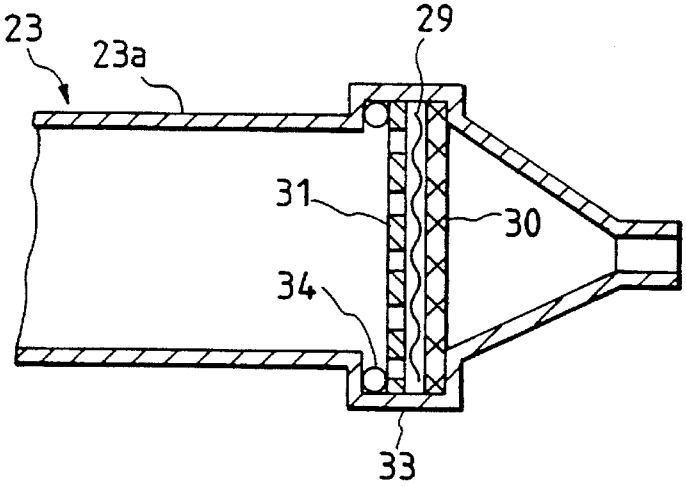
FIG. 4 is a sectional view showing a main portion of a drier according to a third preferred embodiment of the present invention.

As shown in FIG. 4, in the third preferred embodiment, an O-ring 34 is further provided in the flanged portion 33. Specifically, the O-ring 34 is firmly disposed in the flanged portion 33 at an upstream side of the foregoing three-component composite and urges the punching metal plate 31 and thus the three-component composite in a downstream direction. The other structure is the same as that in the first preferred embodiment.

According to the third preferred embodiment, the tight arrangement of the three-component composite in the flanged portion 33 can be reliably achieved by means of elasticity of the O-ring 34.

Now, a fourth preferred embodiment of the present invention will be described with reference to FIG. 5. The fourth preferred embodiment differs from the first preferred embodiment only in structure of the drier 23.

Figure 5:
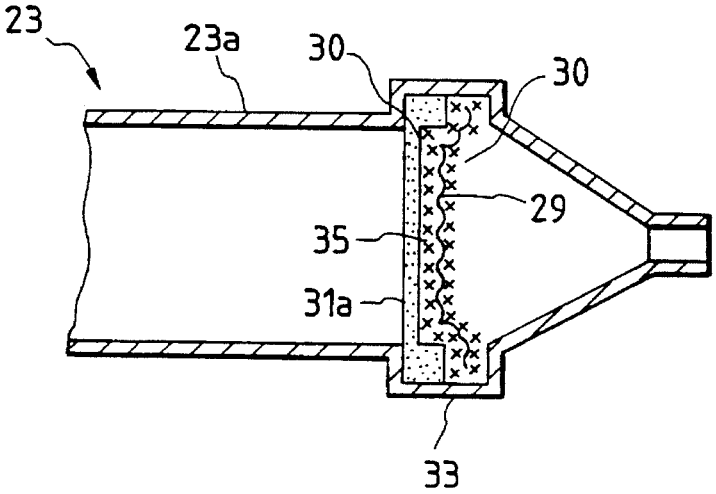
FIG. 5 is a sectional view showing a main portion of a drier according to a fourth preferred embodiment of the present invention.

As shown in FIG. 5, in the fourth preferred embodiment, the filter 29 is sandwiched between a pair of the metal screens 30 to form a composite, and this composite is arranged at a downstream side of a porous sintered metal plate 31*a* in a manner so as to increase a surface area of the filter 29 relative to the flow of the HFC-134*a* refrigerant. Specifically, the porous sintered metal plate 31*a* has a stepped surface 35 having a center recess at the downstream side thereof, and the composite of the filter 29 and a pair of the metal screens 30 is abutted against the stepped surface 35 of the plate 31*a* by deforming the composite so as to follow the contour of the stepped surface 35. Accordingly, the surface area of the filter 29 is increased relative to the refrigerant flow as compared with the case where the filter 29 is arranged perpendicular to the refrigerant flow. As in the foregoing preferred embodiments, the composite of the filter 29, a pair of the metal screens 30 and the porous sintered metal plate 31*a* is tightly mounted in the flanged portion 33 so as to ensure that the HFC-134*a* refrigerant passes through the filter 29 as much as possible.

According to the fourth preferred embodiment, since the surface area of the filter 29 is increased, a capacity for the captured contaminants is increased in accordance therewith.

Now, a fifth preferred embodiment of the present invention will be described with reference to FIG. 6. The fifth preferred embodiment differs from the first preferred embodiment only in structure of the drier 23.

Figure 6:
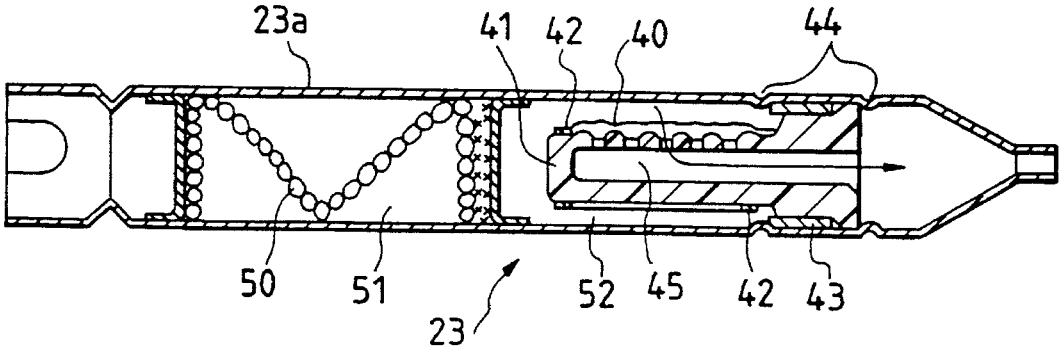
FIG. 6 is a sectional view showing a structure of a drier according to a fifth preferred embodiment of the present invention.

As shown in FIG. 6, in the fifth preferred embodiment, the drier 23 has the drier case 23*a* in which the molecular sieve chamber 51 and the filter chamber 52 are defined adjacent to each other. In the molecular sieve chamber 51, the molecular sieve 50 is arranged in the known manner for working as desiccant.

A filter 40 formed into a cylindrical shape is attached onto an outer periphery of a cylindrical body 41 by means of heat sealing as represented by numeral 42 in FIG. 6. This two-component composite is fixedly provided in the filter chamber 52. Specifically, the drier case 23*a* is formed with a pair of grooves 44, 44 on the circumference thereof, and a downstream end portion of the cylindrical body 41 along with an elastomer 43 is fixed between the grooves 44, 44 using the drawing process so that the two-component composite is firmly mounted in the filter chamber 52. The elastomer 43 is provided for sealing purposes.

The filter 40 is formed of the same material as that of the filter 29 in the foregoing preferred embodiments. The cylindrical body 41 is formed of synthetic resin, such as, fluororesin or polypropylene. Further, as shown in FIG. 6, the cylindrical body 41 is formed with a center bore 45 which is opened at a downstream end of the cylindrical body 41.

In the fifth preferred embodiment, the HFC-134*a* refrigerant passes through the filter 40 and the body 41 into the center bore 45 as indicated by an arrow in FIG. 6. Accordingly, a surface area of the filter 40 relative to the refrigerant flow can be increased so that a large amount of the contaminants can be captured.

Now, a sixth preferred embodiment of the present invention will be described with reference to FIGS. 7 and 8. The sixth preferred embodiment differs from the first preferred embodiment only in structure of the drier 23.

Figure 7:
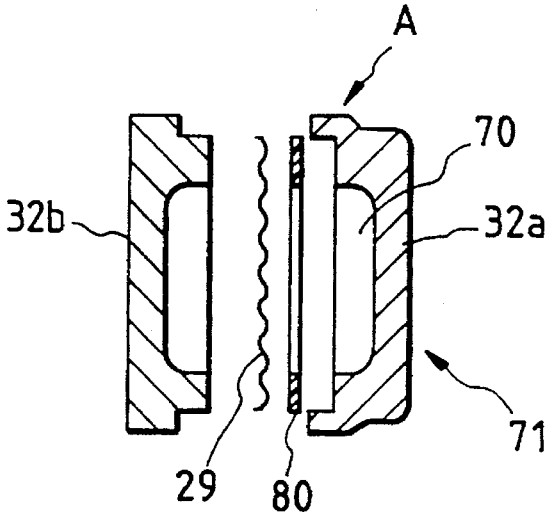
FIG. 7 is a sectional view for explaining an arrangement of a filter assembly according to a sixth preferred embodiment of the present invention, wherein the filter assembly is shown in a disassembled state.
Figure 8:
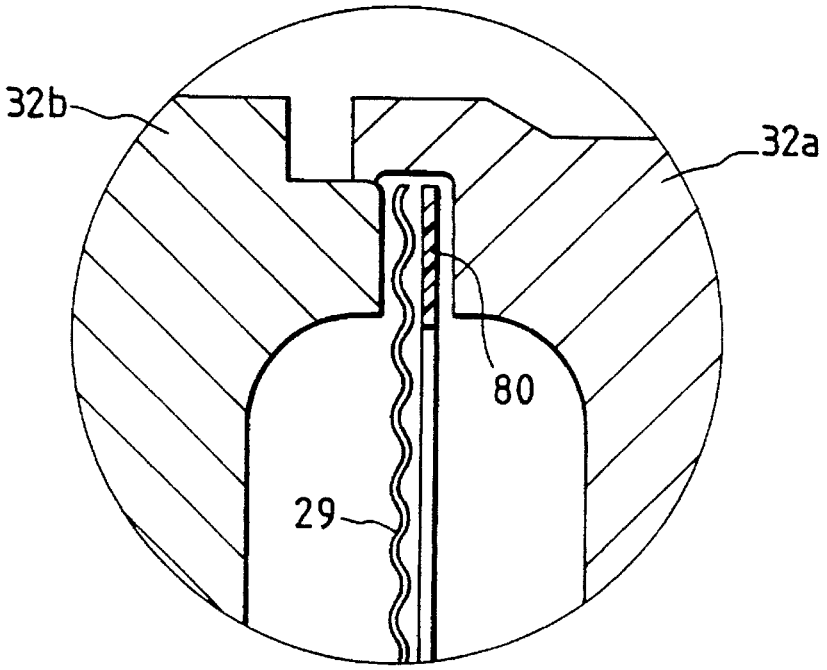
FIG. 8 is an enlarged sectional view of a portion designated by alphabet A in FIG. 7, wherein the filter assembly is shown in an assembled state.

As shown in FIGS. 7 and 8, in the sixth preferred embodiment, the filter 29 is sandwiched between a pair of disk-shaped members 32*a*, 32*b* via a gasket 80 to form a filter assembly 71, and this assembly 71 is tightly mounted in the flanged portion 33. Each of the disk-shaped members 32*a*, 32*b* is a porous member formed of porous substance, such as, porous sintered metal, porous ceramic, porous resin, porous metallic fiber, porous paper or porous non-woven fiber. As shown in FIG. 7, each of the disk-shaped members 32*a*, 32*b* has a stepped surface formed with a center recess 70. The assembly 71 is formed by confronting the center recesses 70 each other with the filter 29 and the gasket 80 interposed between the stepped surfaces of the disk-shaped members 32*a*, 32*b*. The gasket 80 is of a ring shape arid has an outer diameter which is substantially the same as that of the filter 29.

According to the sixth preferred embodiment, since the recesses 70 work as reservoirs for the captured contaminants, a large amount of the contaminants can be dealt with.

Now, a seventh preferred embodiment of the present invention will be described with reference to FIG. 9. The seventh preferred embodiment differs from the first preferred embodiment only in structure of the drier 23.

Figure 9:
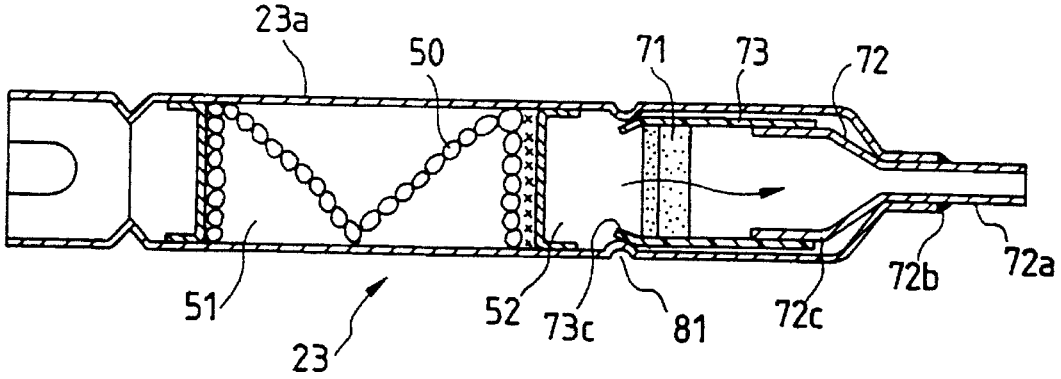
FIG. 9 is a sectional view showing a structure of a drier according to a seventh preferred embodiment of the present invention.

As shown in FIG. 9, in the seventh preferred embodiment, the drier 23 has the drier case 23*a* in which the molecular sieve chamber 51 and the filter chamber 52 are defined adjacent to each other. In the molecular sieve chamber 51, the molecular sieve 50 is arranged in the known manner for working as desiccant.

On the other hand, in the filter chamber 52, a stepped pipe 72 is fixedly provided at a downstream side of the filter chamber 52 and extends through a downstream end or an outlet of the drier case 23*a* for forming a portion of the refrigerant flow passage outside the drier 23. Specifically, the stepped pipe 72 has a smaller-diameter section 72*a* at its downstream side, a larger-diameter section 72*c* at its upstream side and an intermediate oblique portion connecting the sections 72*a* and 72*c*. The stepped pipe 72 is fixed to the outlet of the drier case 23*a* at the smaller-diameter section 72*a* by brazing as represented by numeral 72*b* in FIG. 9, so that the larger-diameter section 72*c* and the intermediate oblique section are located in the filter chamber 52.

A tube 73 is further provided in the filter chamber 52 at an upstream side of the stepped pipe 72. Specifically, a downstream end portion of the tube 73 hermetically receives the larger-diameter section 72*c* of the stepped pipe 72 while an upstream end portion of the tube 73 tightly receives the filter assembly 71 used in the foregoing sixth preferred embodiment. The tube 73 has an upstream end 73*c* which tightly abuts against an inner wall of a groove 81 so as to prevent generation of noise which is otherwise caused due to the refrigerant flow.

The tube 73 is formed of elastomer, such as, ethylene propylene rubber or ethylene propylene terpolymer rubber, which is non-polar to the ester lubricating oil and the HFC-134*a* refrigerant. Accordingly, the larger-diameter section 72*c* of the stepped pipe 72 can be hermetically received in the tube 73 by temporally stretching the downstream end portion of the tube 73 to receive the larger-diameter section 72*c* therein so that the downstream end portion of the tube 73 firmly holds the larger-diameter section 72*c* by its contracting action. On the other hand, the filter assembly 71 can be tightly received in the tube 73 by temporally stretching the upstream end portion of the tube 73 to receive the filter assembly 71 therein so that the upstream end portion of the tube 73 firmly holds the filter assembly 71 by its contracting action.

Now, an eighth preferred embodiment of the present invention will be described with reference to FIGS. 10–12. The eighth preferred embodiment is featured in structure of a discharge muffler 86 of the refrigerant compressor 21.

Figure 10:
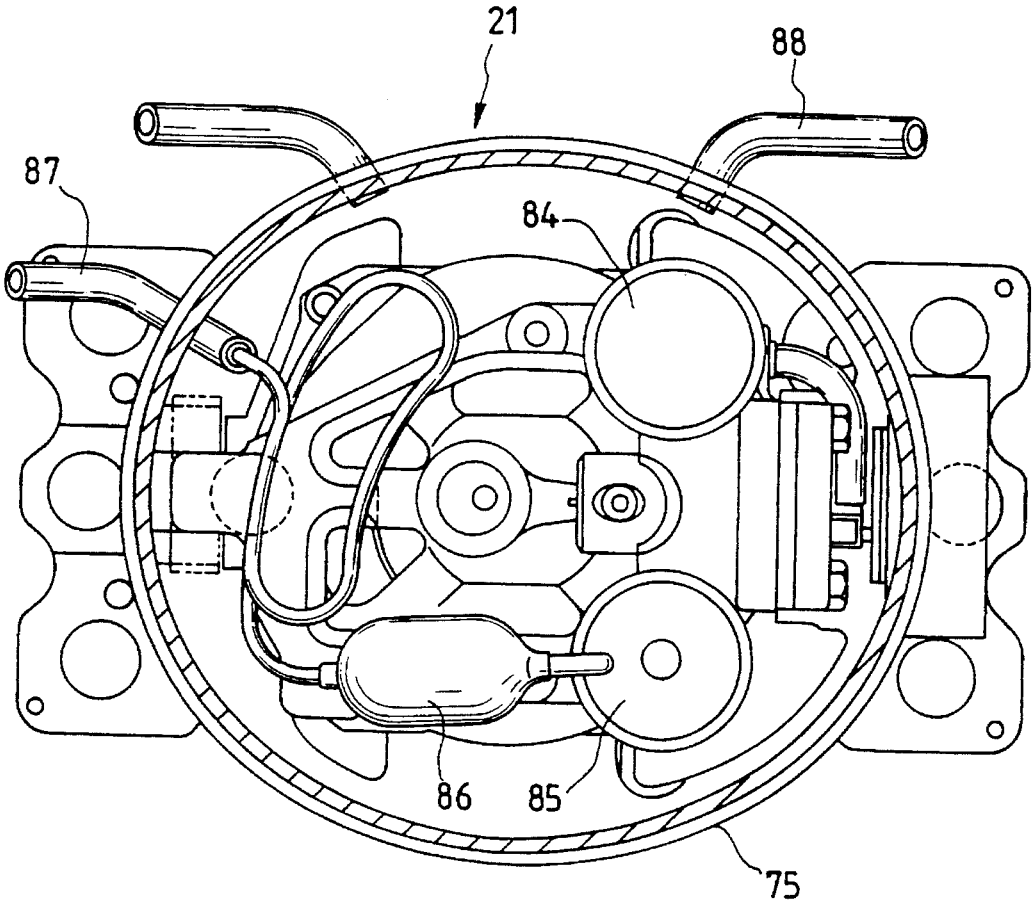
FIG. 10 is a horizontally-broken view showing an internal arrangement of a refrigerant compressor on a top plan, according to an eighth preferred embodiment of the present invention.
Figure 11:
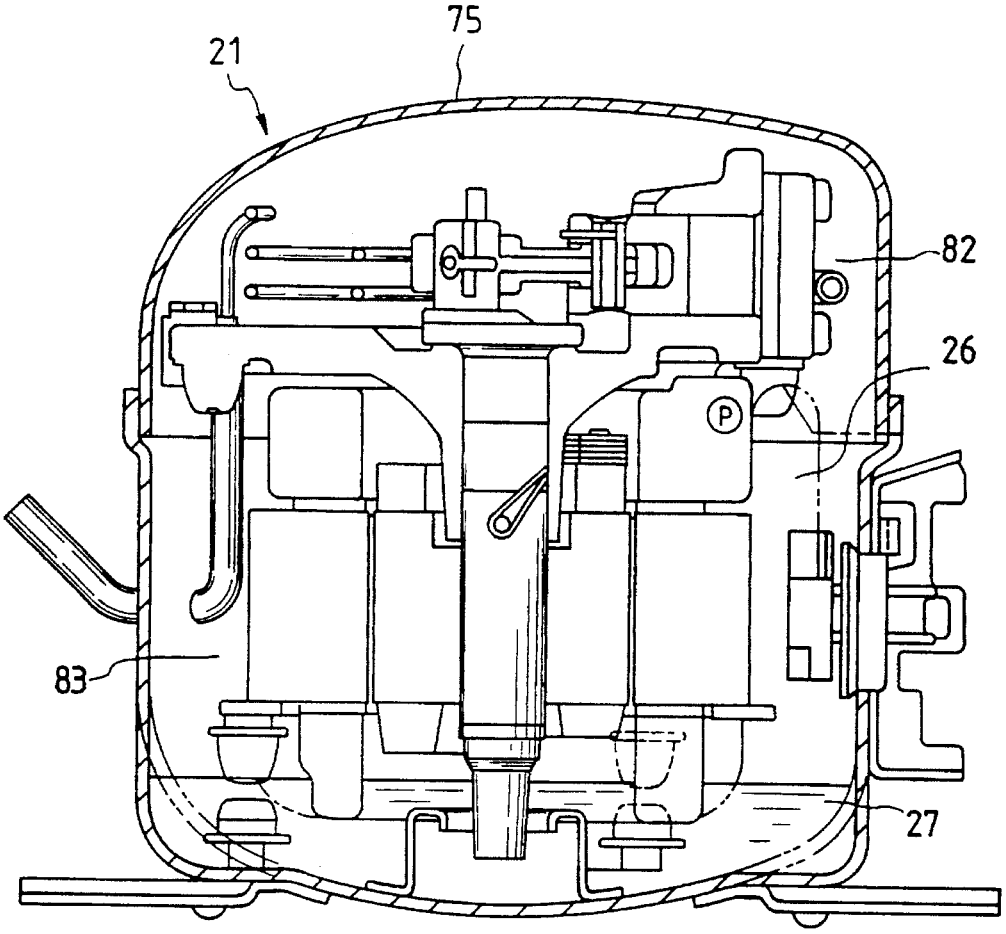
FIG. 11 is a vertically-broken view showing an internal arrangement of the refrigerant compressor on a side elevation, according to the eighth preferred embodiment.
Figure 12:
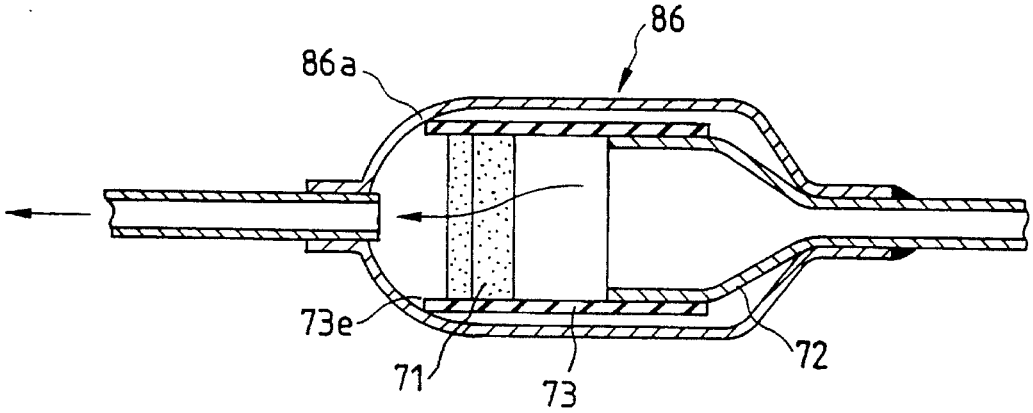
FIG. 12 is a sectional view showing a structure of a discharge muffler of the refrigerant compressor according to the eighth preferred embodiment.

FIG. 10 is a horizontally-broken view showing an internal arrangement of the refrigerant compressor 21 on a top plan, FIG. 11 is a vertically-broken view showing an internal arrangement of the refrigerant compressor 21 on a side elevation, and FIG. 12 is a sectional view showing a structure of the discharge muffler 86 incorporated in the refrigerant compressor 21.

In FIGS. 10–12, the refrigerant compressor 21 has a sealed casing 75 which includes therein a compression element 82 and a motor element 83 in the known manner. Specifically, the compression element 82 is connected at its intake side to an intake refrigerant passage 84 for introducing the HFC-134*a* refrigerant conducted via an intake tube 88 which is connected to the evaporator. On the other hand, the compression element 82 is connected at its discharge side to a discharge refrigerant passage 85 for discharging the compressed refrigerant via the discharge muffler 86 to a discharge tube 87 which is connected to the condenser. The ester lubricating oil 27 is stored in the sealed casing 75 at its bottom while the HFC-134*a* refrigerant 26 is filled in the space in the sealed casing 75 as in the known manner.

As shown in FIG. 12, the stepped pipe 72 is fixedly provided at an inlet side of the discharge muffler 86 and extends through an inlet of the discharge muffler 86 for forming a portion of the refrigerant flow passage outside the discharge muffler 86. As in the seventh preferred embodiment, the stepped pipe 72 is fixed to the inlet of the discharge muffler 86 at the smaller-diameter section by brazing, so that the larger-diameter section and the intermediate oblique section are located in the discharge muffler 86. The elastomer tube 73 is hermetically connected to the stepped pipe 72 and tightly receives the filter assembly 71 therein in the same manner as in the seventh preferred embodiment. The tube 73 has a downstream end 73*e* which tightly abuts against a curved inner wall 86*a* of the discharge muffler 86 so as to prevent generation of noise which is otherwise caused due to the refrigerant flow.

Although a temperature in the discharge refrigerant flow passage in the refrigerant compressor 21 reaches about 150° C., the filter 29 formed of a film material, such as, polytetrafluoroethylene bears up to about 200° C. so that it can be used in the discharge refrigerant flow passage in the refrigerant compressor 21 without any difficulty.

The highest amount of the organic substances remain in the compressor due to its far more complicated structure than the other components in the refrigeration system, and thus, the contaminants are most likely to be generated in the compressor. Accordingly, by providing the filter, which can capture the contaminants, in the refrigerant flow passage in the sealed casing of the compressor, the contaminants can be reliably and quickly captured.

In the eighth preferred embodiment, the filter assembly is provided in the discharge refrigerant flow passage of the compressor. On the other hand, the filter assembly may be provided in the intake refrigerant flow passage of the compressor.

Hereinbelow, relationship between nominal pore size of the film filter and capturing effect of the contaminants will be explained.

A test was performed by changing the pore size of the film filter so as to find out the optimal pore size of the filter. In the test, the refrigeration system is operated for a given time period so as to compare variations of flow rates of the capillary tube before and after the start of the test.

Figure 13:
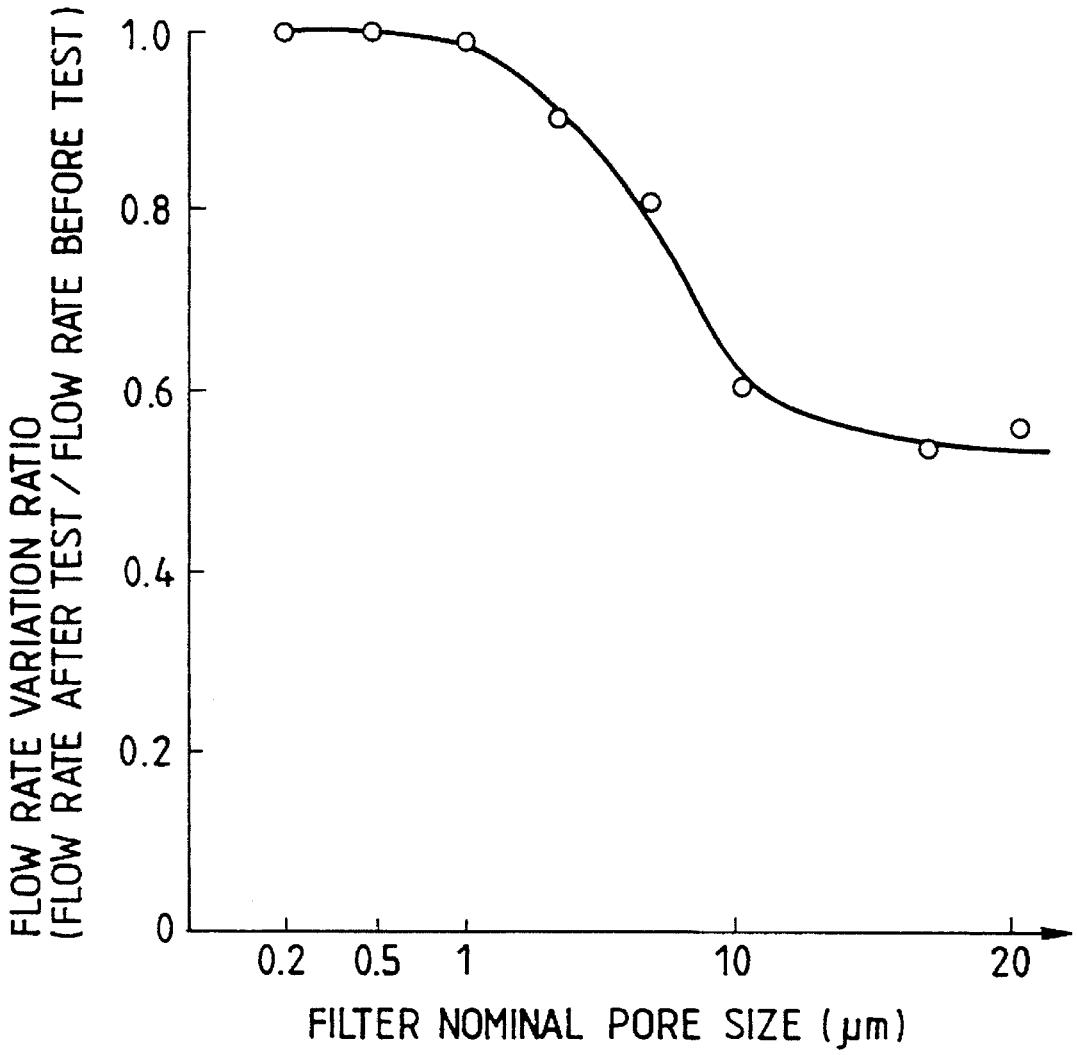
FIG. 13 is a characteristic graph showing a relationship between a nominal pore size of a film filter and a flow rate variation ratio at a capillary tube.
Figure 14:
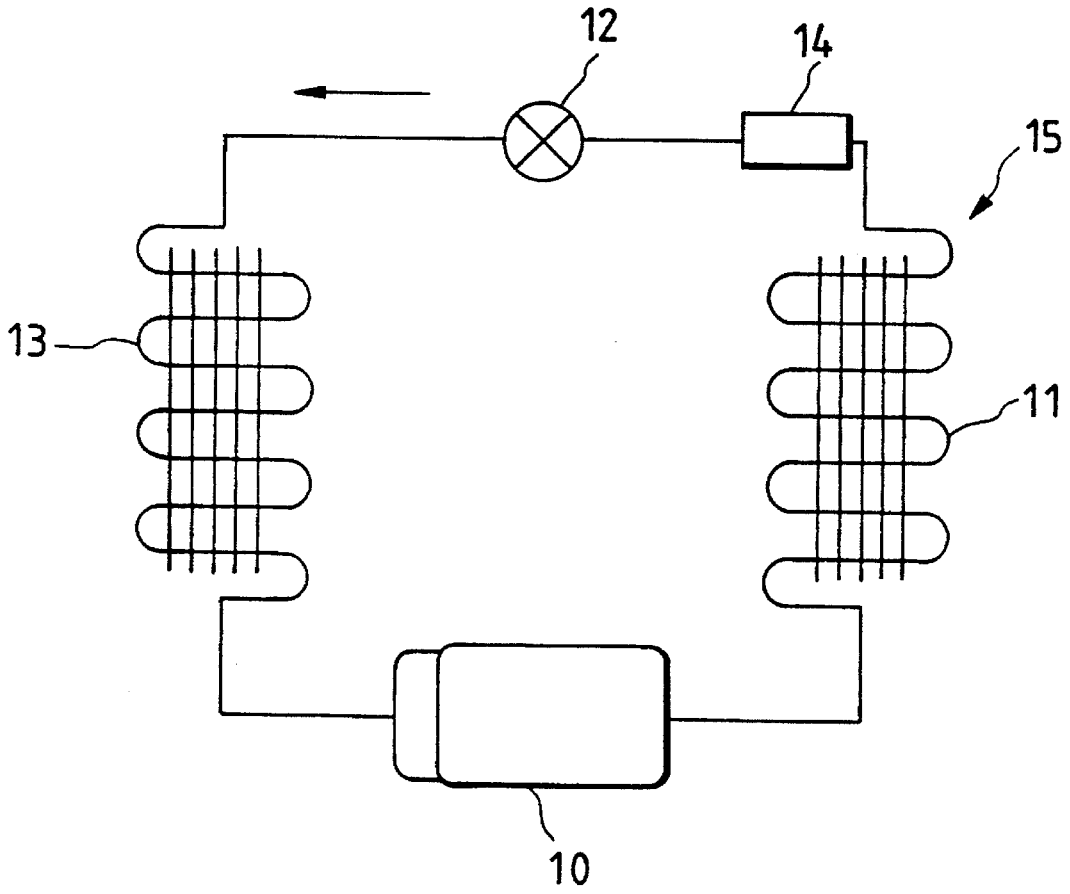
FIG. 14 PRIOR ART
FIG. 14 is a diagram schematically showing a conventional refrigeration system.

FIG. 13 is a characteristic graph showing the test result. In the graph, the vertical axis represents a flow rate variation ratio (flow rate after test/flow rate before test) at the capillary tube, and the horizontal axis represents a nominal pore size (μm) of the film filter. As the graph shows, the capturing effect of the contaminants is small when the filter nominal pore size is not less than 10 μm where the flow rate variation before and after the test is constantly large, that is, the flow rate variation ratio is small in FIG. 13. On the other hand, when the filter nominal pore size is less than 10 μm, the capturing effect of the contaminants is increased. It is further understood from the graph that substantially all the contaminants can be captured when the filter nominal pore size is between 0.2 μm and 0.5 μm since the graph shows substantially no flow rate variation before and after the test with the filter nominal pore size within that range.

The filter is in the form of a film where small pores having different sizes are formed. Accordingly, the nominal pore size is used in the graph of FIG. 13. As understood from the graph, it is preferable that the nominal pore size of the film filter is less than 10 μm, and it is most preferable that the film filter is formed with a number of the pores, per unit area, having the nominal pore size between 0.2 μm and 0.5 μm.

It is to be understood that this invention is not to be limited to the preferred embodiments and modifications described above, mad that various changes and modifications may be made without departing from the spirit and scope of the invention as defined in the appended claims.

What is claimed is:

1. A refrigeration system comprising:

a series of a refrigerant flow passage including therein a refrigerant compressor, a condenser, a drier, an expansion mechanism and an evaporator;

a refrigerant containing, as a main component, a chlorine-free carbon fluoride compound;

a lubricating oil containing ester as a main component, said lubricating oil having solubility with said refrigerant; and a filter provided in said refrigerant flow passage, said filter formed of a film material being one of fluororesin, cellulose ester and silica fiber.

2. The refrigeration system as set forth in claim 1, wherein said filter is provided in said refrigerant flow passage as being sandwiched between porous members, said porous members supporting said filter therebetween.

3. The refrigeration system as set forth in claim 2, wherein said filter and said porous members form a composite which is tightly mounted in said refrigerant flow passage.

4. The refrigeration system as set forth in claim 2, wherein said porous members are a metal screen and a punching metal plate, respectively.

5. The refrigeration system as set forth in claim 2, wherein each of said porous members is formed of a porous substance being one of porous sintered metal, porous ceramic, porous resin, porous metallic fiber, porous paper and porous non-woven fiber.

6. The refrigeration system as set forth in claim 5, wherein each of said members has a stepped surface having a center recess, and wherein said members are arranged in said refrigerant flow passage with said stepped surfaces facing each other so as to interpose said filter between said stepped surfaces.

7. The refrigeration system as set forth in claim 1, wherein said filter is provided in said drier.

8. The refrigeration system as set forth in claim 1, wherein said filter is provided in said refrigerant compressor.

9. The refrigeration system as set forth in claim 2, wherein said filter and said porous members form a composite which is covered at its circumference by at least one seal collar, said seal collar formed of synthetic resin.

10. The refrigeration system as set forth in claim 9, wherein said composite and said seal collar are tightly mounted in said refrigerant flow passage.

11. The refrigeration system as set forth in claim 2, wherein said filter and said porous members form a composite which is provided in said refrigerant flow passage as being concave in a given direction so as to increase a surface area of the filter relative to the refrigerant flowing in the refrigerant flow passage.

12. The refrigeration system as set forth in claim 11, wherein said composite is supported by another porous member formed of a porous substance, said another porous member having a stepped surface having a center recess, and wherein said composite is deformed following a contour of said stepped surface.

13. The refrigeration system as set forth in claim 1, wherein a nominal pore size of said filter is less than 10 μm.

14. The refrigeration system as set forth in claim 13, wherein said nominal pore size is between 0.2 μm and 0.5 μm.

15. A refrigeration system comprising:

a series of a refrigerant flow passage including therein a refrigerant compressor, a condenser, a drier, an expansion mechanism and an evaporator;

a refrigerant containing, as a main component, a chlorine-free carbon fluoride compound;

a lubricating oil containing ester as a main component, said lubricating oil having solubility with said refrigerant;

a filter of a cylindrical shape provided in said refrigerant flow passage, said filter formed of a film material being one of fluororesin, cellulose ester, polycarbonate and silica fiber; and a cylindrical member received in said cylindrical filter, said cylindrical member formed of synthetic resin and fixed to said cylindrical filter by means of heat sealing.

16. The refrigeration system as set forth in claim 15, wherein said filter and said member are provided in said drier.

17. A refrigeration system comprising:

a series of a refrigerant flow passage including therein a refrigerant compressor, a condenser, a drier, an expansion mechanism and an evaporator;

a refrigerant containing, as a main component, a chlorine-free carbon fluoride compound;

a lubricating oil containing ester as a main component, said lubricating oil having solubility with said refrigerant;

a tube provided in said drier, said tube formed of elastomer which is non-polar to said refrigerant and said lubricating oil, said tube extending along an inner wall of said drier; and a filter prodded in said tube, said filter formed of a film material being one of fluororesin, cellulose ester, polycarbonate and silica fiber.

18. In a refrigeration system having:

a series of a refrigerant flow passage including therein a refrigerant compressor, a condenser, a drier, an expansion mechanism and an evaporator;

a refrigerant containing, as a main component, a chlorine-free carbon fluoride compound; and a lubricating oil containing ester as a main component, said lubricating oil having solubility with said refrigerant, said refrigerant compressor comprising:

a sealed casing;

a tube provided in the refrigerant flow passage within said sealed casing, said tube formed of elastomer which is non-polar to said refrigerant and said lubricating oil; and a filter provided in said tube, said filter formed of a film material being one of fluororesin, cellulose ester, polycarbonate and silica fiber.

* * * * *